US006504293B1

(12) United States Patent
Koizumi et al.

(10) Patent No.: US 6,504,293 B1
(45) Date of Patent: Jan. 7, 2003

(54) CATHODE RAY TUBE HAVING AN IMPROVED CATHODE

(75) Inventors: Sachio Koizumi, Mobara (JP); Toshifumi Komiya, Sakura (JP); Norio Iwamura, Chousei (JP)

(73) Assignee: Hitachi, Ltd., Tokyo (JP)

( * ) Notice: Subject to any disclaimer, the term of this patent is extended or adjusted under 35 U.S.C. 154(b) by 185 days.

(21) Appl. No.: 09/589,804

(22) Filed: Jun. 9, 2000

(30) Foreign Application Priority Data

Jun. 14, 1999 (JP) ..... 11-166764

(51) Int. Cl.[7] ..... H01J 1/14; H01J 19/06; H01K 1/04

(52) U.S. Cl. ..... 313/346 R; 313/346 DC; 313/446

(58) Field of Search ..... 313/346 R, 346 DC, 313/414, 446, 447, 448, 449, 452, 37

(56) References Cited

U.S. PATENT DOCUMENTS 4,797,593 A 1/1989 Saito et al. ..... 313/346 R
4,924,137 A * 5/1990 Watanabe et al. ..... 313/337
4,980,603 A 12/1990 Kimura et al. ..... 313/346 R
5,216,320 A * 6/1993 Koizumi et al. ..... 313/346 R
6,034,469 A * 3/2000 Uda et al. ..... 313/346 R
6,124,667 A * 9/2000 Komiya et al. ..... 313/346 R
6,191,528 B1 * 2/2001 Iwamura et al. ..... 313/446
6,252,341 B1 * 6/2001 Hasegawa et al. ..... 313/346 R

* cited by examiner

*Primary Examiner*—Vip Patel
*Assistant Examiner*—Kevin Quarterman
(74) *Attorney, Agent, or Firm*—Antonelli, Terry, Stout & Kraus, LLP

(57) ABSTRACT

A cathode ray tube is provided with a phosphor screen and an electron gun including a cathode having an electron-emissive material layer formed on a surface of a cathode base metal. The electron-emissive material layer includes a first layer made of an alkaline earth metal oxide on the surface of the cathode base metal, a second layer on a surface of the first layer which is an alkaline earth metal oxide layer containing at least one rare earth metal oxide in a range of 0.1 to 10 weight percent, the at least one rare earth metal oxide having a particle size distribution in which the number of particles having a maximum diameter over 5 $\mu$m m is one or none, the number of particles having a maximum diameter in a range of from 1 $\mu$m to 5 $\mu$m is in a range of from 2 to 30, as measured in an area of 45 $\mu$m×45 $\mu$m at a center of a top surface of the second layer, the maximum diameter being defined as a perpendicular projection, onto a horizontal direction, of tangents to extremities of a profile of each of the particles. The cathode base metal is made chiefly of nickel and containing at least one reducing agent, and a thickness of a portion of the cathode base metal in contact with the electron-emissive material layer is in a range of 0.10 to 0.16 mm.

5 Claims, 7 Drawing Sheets

| PARTICLE SIZE DISTRIBUTION | | |
|---|---|---|
| PARTICLE SIZE Dmax ($\mu$m) | PRESENT INVENTION | PRIOR ART |
| 1 > Dmax | neglected | neglected |
| 5 ≧ Dmax ≧ 1 | 2 to 30 (pieces/45×45$\mu m^2$) | 10 or more (pieces/45×45$\mu m^2$) |
| Dmax > 5 | 1 or less | 3 or more |

| PARTICLE SIZE DISTRIBUTION | | |
|---|---|---|
| PARTICLE SIZE Dmax (μm) | PRESENT INVENTION | PRIOR ART |
| 1 > Dmax | neglected | neglected |
| 5 ≧ Dmax ≧ 1 | 2 to 30 (pieces/45×45μm$^2$) | 10 or more (pieces/45×45μm$^2$) |
| Dmax > 5 | 1 or less | 3 or more |

CATHODE RAY TUBE HAVING AN IMPROVED CATHODE

BACKGROUND OF THE INVENTION

The present invention relates to a cathode ray tube such as a color picture tube or a color display tube including a cathode having an electron emissive material layer, and particularly to a cathode ray tube having improved high-current operational characteristics and reduced a warm-up time required for formation of an image after a heater has been turned on.

A cathode ray tube such as a color cathode ray tube used for a monitor at a terminal of office automation equipment, for example, generally has a vacuum envelope comprised of a panel, a neck and a funnel for connecting the panel and the neck, a phosphor screen comprised of three-color phosphor picture elements coated on an inner surface of the panel, and an electron gun housed in the neck.

The electron gun for the cathode ray tube has three cathodes for generating the three electron beams in a horizontal direction and a plurality of electrodes located downstream of the three cathodes and spaced in the direction of travel of the electron beams for forming a main lens. The three electron beams from the cathodes enter the main lens, are accelerated and focused appropriately, and then impinge upon the phosphor screen.

The phosphor screen comprises three-color phosphor picture elements fabricated in the form of dots or stripes and arranged at a predetermined pitch, and a color selection electrode such as a shadow mask is closely spaced from the phosphor screen between the phosphor screen and the electron gun.

In this type of cathode ray tubes, each cathode in the electron gun is provided with an electron-emissive material layer coated on a base metal and a heater for heating the base metal such that electrons are emitted from the electron-emissive material layer.

Some electron-emissive material layers employ a multi-layer structure suitable for high-current operation and for prevention of peeling of the electron-emissive material layers off the base metal, a two-layer structure, for example.

In the two-layer structure, a first layer on the base metal side comprises alkaline earth metal oxide powders converted from triple carbonates containing Ba, Sr, and Ca carbonates, ($(Ba,Sr,Ca)CO_3$), and a second layer, i.e., an upper layer, comprises the same alkaline earth metal oxide powders as in the first layer and 1 to 3 weight percent of a rare earth metal oxide dispersed in the alkaline earth metal oxide powders. A barium scandate $Ba_2Sc_2O_5$, $BaSc_2O_4$ or $Ba_3Sc_4O_9$, a composite oxide of Ba and Sc, is used as the rare earth metal oxide dispersed in the second layer.

The operating temperature for the electron-emissive material layer comprised of these alkaline earth metal oxides (BaO, SrO, CaO) and the rare earth metal oxides dispersed therein is usually 1000 K.

A reducing agent contained in the cathode base metal diffuses to the surface of the cathode base metal at this temperature, and reduces the alkaline earth metal oxide BaO. The thicker the base metal, the longer the reducing agent continues to diffuse to the surface of the base metal, resulting in increased cathode life, as disclosed in detail in Japanese Patent Application Laid-open No. Hei 5-12983 (laid-open on Jan. 22, 1993).

A known cathode base metal is made of material containing Ni as a main component and incorporated with a low concentration of a reducing element such as silicon (Si) or magnesium (Mg).

Properties of the base metal are related to the mechanism of electron emission from a cathode, and there are various opinions on the mechanism of the electron emission.

Generally it is thought that the reducing agent in the base metal reduces the barium oxide to produce free barium, and this free barium diffuses in the electron-emissive material layer, forms a donor level in the alkaline metal oxide and thereby emits electrons.

Usually, the emission life is determined by the exhaustion of the reducing agent in the cathode base metal and the evaporation of the electron-emissive material BaO. As for the exhaustion of the reducing agent in the cathode base metal, the thicker the cathode base metal, the longer the reducing agent continues to diffuse to the surface of the cathode base metal, resulting in longer cathode life.

Because of the above, a cathode base metal of 0.19 mm in thickness has been popular, following a specification for cathodes of types previous to cathodes of the type having the rare earth metal dispersed in the electron-emissive layer.

The evaporation of the electron-emissive material BaO is determined by the temperature of the electron-emissive material layer, but the exhaustion of the reducing agent in the cathode base metal is reduced by the effects of the barium scandate dispersed in the electron-emissive layer.

A high concentration of free barium in the electron-emissive material layer suppresses reduction of barium oxide by the reducing agent in the base metal, and thereby reduces the exhaustion of the reducing agent.

SUMMARY OF THE INVENTION

In the above-explained prior art, sufficient consideration has been given to emission life characteristics by employing the two-layer electron-emissive material layer and dispersing the rare earth metal oxide in the electron-emissive material layers but no consideration has been given to a warm-up time required for formation of an image on a cathode ray tube such as a color display tube after an image display set such as a monitor has been switched on. This warm-up time will be hereinafter referred to as the image-forming warm-up time.

The image-forming warm-up time is a time required for the electron-emissive material layer to reach a required temperature and is determined by the heat capacity of the heater-cathode system.

Especially, in the case of a color display tube used for a monitor of information equipment such as a personal computer (Pc), there is a tendency for heaters to be automatically turned off during a waiting time when the information equipment is not used, for the purpose of power saving, and consequently, the image-forming warm-up time causes a problem when the information equipment is used again after the waiting time.

Empirically, it is desirable that a time required for the screen brightness to reach 50% of the required brightness is limited to eight seconds or less (or a time required for the phosphor screen to become faintly luminous must be limited to three to four seconds) after power turn on, and if the time exceeds eight seconds, the operator sometimes feels irritated.

Power saving is also essential in view of energy saving and the protection of environment, and therefore there is a demand for reduction of the image-forming warm-up time after heater power turn on following the waiting time.

The present invention solves the above problem, and it is an object of the present invention to provide a cathode ray tube such as a color display tube capable of retaining the basic characteristics such as high-current operation and long emission life and reducing the image-forming warm-up time.

To accomplish the above object, in accordance with an embodiment of the present invention, there is provided a cathode ray tube comprising a vacuum envelope including a panel portion, a neck portion and a funnel portion for connecting the panel portion and the neck portion, a phosphor screen formed on an inner surface of the panel portion, and an electron gun housed in the neck portion and including a cathode having an electron-emissive material layer formed on a surface of a cathode base metal, the electron-emissive material layer comprising: a first layer made of an alkaline earth metal oxide on the surface of the cathode base metal, a second layer being an alkaline earth metal oxide layer containing at least one rare earth metal oxide in a range of 0.1 to 10 weight percent, the at least one rare earth metal oxide having a particle size distribution in which the number of particles having a maximum diameter over 5 $\mu$m is one or none, the number of particles having a maximum diameter in a range of from 1 $\mu$m to 5 $\mu$m is in a range of from 2 to 30, as measured in an area of 45 $\mu$m×45 $\mu$m at a center of a top surface of the second layer, the maximum diameter Dmax being defined as a perpendicular projection, onto a horizontal direction, of tangents to extremities of a profile of each of the particles, the second layer being formed on a surface of the first layer; the cathode base metal being made chiefly of nickel and containing at least one reducing agent, and a thickness of a portion of the cathode base metal in contact with the electron-emissive material layer being in a range of 0.10 to 0.16 mm.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail by reference to the drawings.

Figure 1:
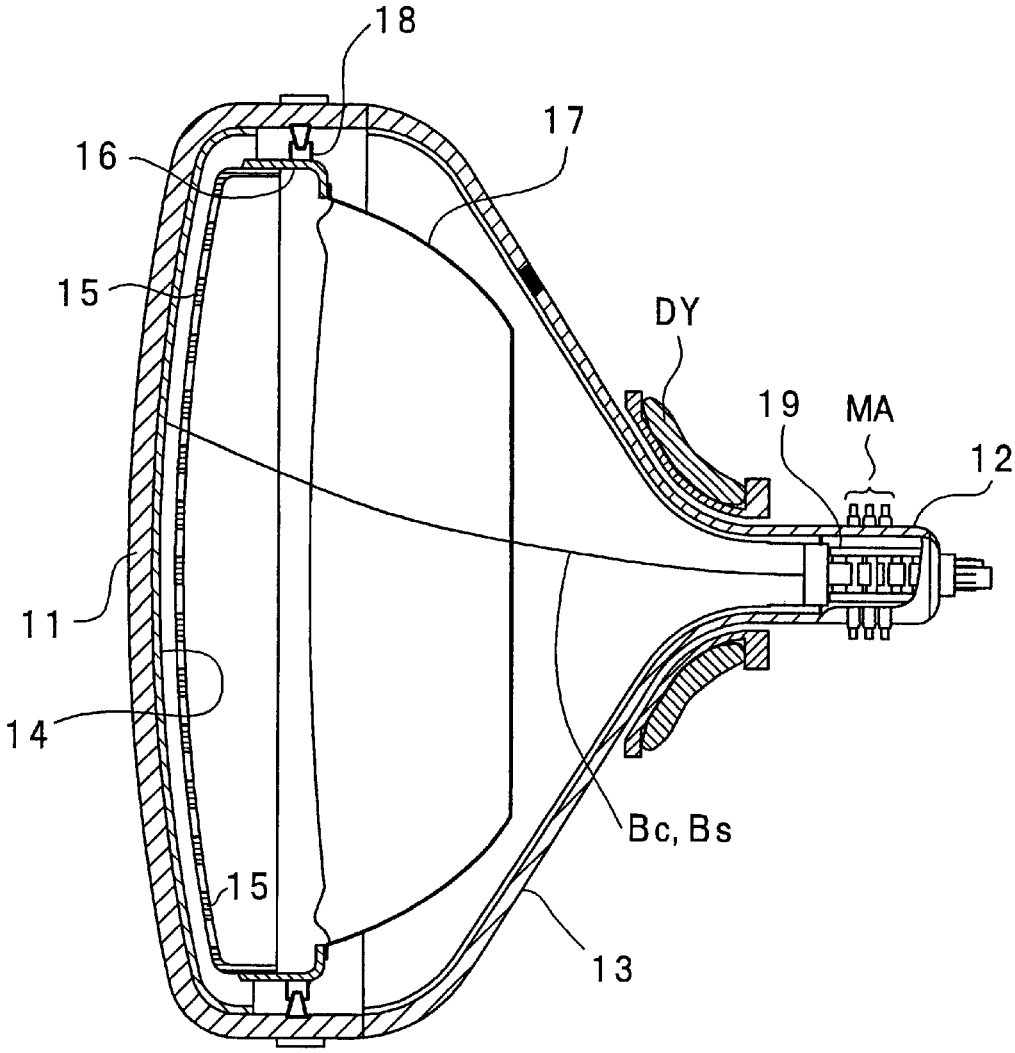
FIG. 1 is a cross-sectional view showing an overall construction of a shadow mask type color cathode ray tube in accordance with an embodiment of the present invention.

FIG. 1 is a cross-sectional view showing an overall construction of a shadow mask type color cathode ray tube in accordance with an embodiment of the present invention.

Reference numeral 11 denotes a panel portion, 12 is a neck portion, 13 is a funnel portion, 14 is a phosphor screen, 15 is a shadow mask having a large number of electron beam apertures therein, 16 is a mask frame, 17 is a magnetic shield, 18 is a shadow mask suspension mechanism, 19 is an electron gun for emitting three electron beams, one center electron beam Bc and two side electron beams Bs, DY is a deflection yoke for deflecting the electron beams horizontally and vertically, and MA is an external magnetic device for adjusting color purity and the like.

In FIG. 1, a vacuum envelope comprises the panel portion 11, the funnel portion 13 and the neck portion 12, the phosphor screen 14 is formed on the inner surface of the panel portion 11, the mask frame 16 having the shadow mask 15 and the magnetic shield 17 fixed thereto is suspended within the panel portion 11 by the shadow mask suspension mechanism 18, the panel portion 11 is frit-sealed to the funnel portion 13 by heat-fusing a glass frit, the electron gun 19 is mounted into the neck portion 12 joined to the funnel portion 13, and then the vacuum envelope is sealed off after evacuation of the air herefrom.

The three electron beams Bc, Bs emitted from the electron gun 19 housed in the neck portion 12 are deflected in horizontal and vertical directions by the deflection yoke DY around the transition region between the neck portion 12 and the funnel portion 13, and are transmitted through electron beam apertures in the shadow mask 15 serving as a color selection electrode to strike the phosphor picture elements of their intended colors forming the phosphor screen 14 and form an image.

Figure 2:
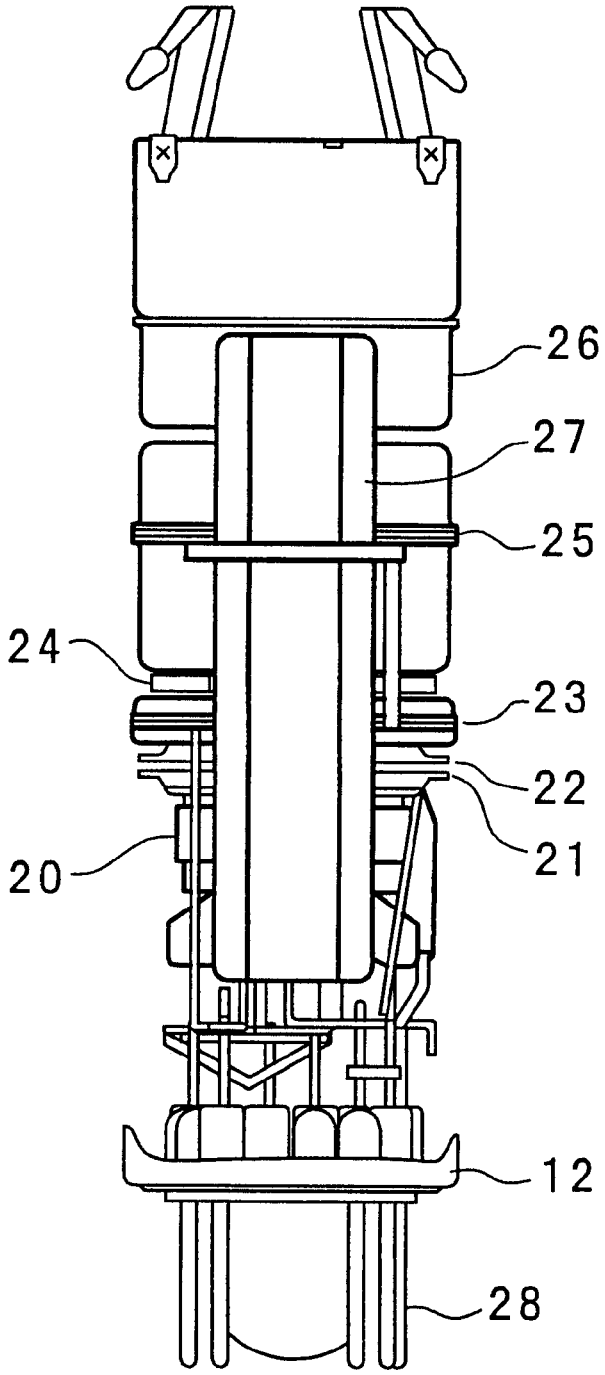
FIG. 2 is a plan view showing an exemplary construction of an electron gun used for a color cathode ray tube of the present invention.

FIG. 2 is a plan view showing a structural example of an electron gun used for a color cathode ray tube of the present invention. Reference numeral 20 denotes a cathode structure, an example of which will be described in greater detail subsequently in connection with FIGS. 3 and 4. Reference numeral 21 denotes a first electrode (a control electrode), 22 is a second electrode (an accelerating electrode), 23, 24 and 25 are third, fourth and fifth electrodes (focus electrodes), respectively, 26 is a sixth electrode (an anode), 27 are multiform glasses (only one of which is shown), and 28 are stem pins.

The cathode structure 20, the first to sixth electrodes 21 to 26 are coaxially fixed on a pair of multiform glasses 27 with their support tabs embedded in the multiform glasses.

Electron beams emitted from the cathode structure 20 are appropriately accelerated and focused by the first electrode 21, the second electrode 22, the third electrode 23, the fourth electrode 24, the fifth electrode 25 and the sixth electrode 26, and are projected toward the phosphor screen from the sixth electrode 26. The stem pins 28 serve as terminals for applying required voltages or video signals to the respective electrodes forming the electron gun 19.

Figure 3:
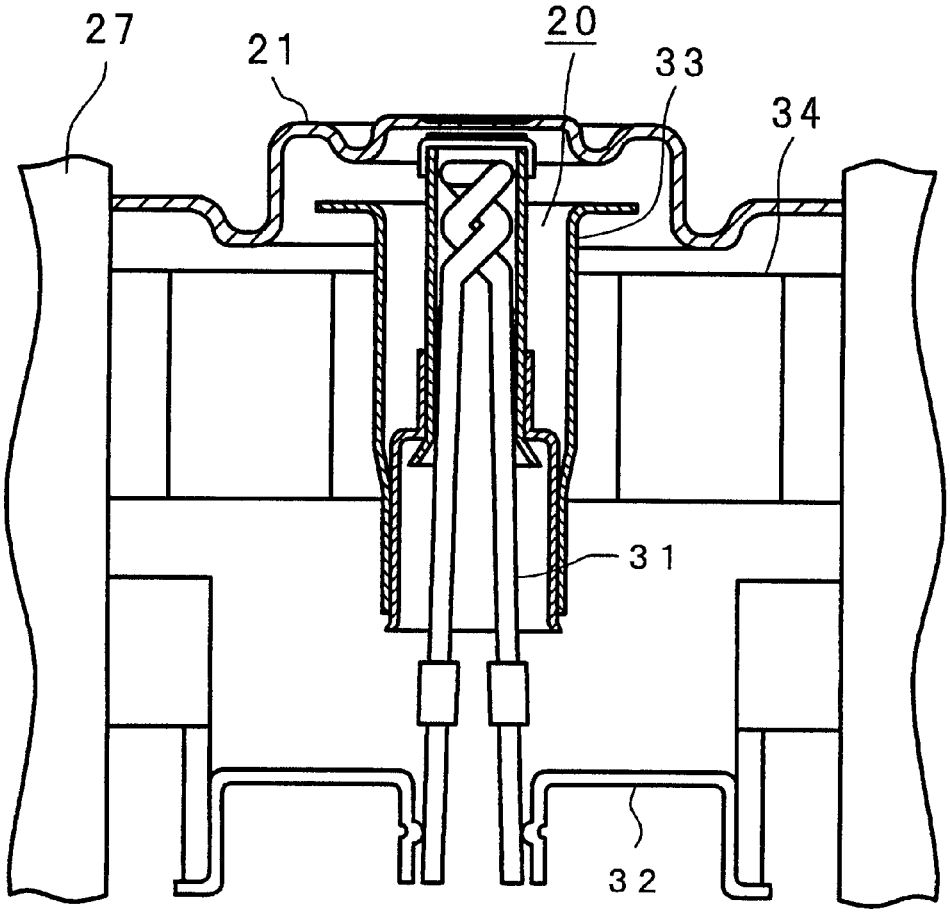
FIG. 3 is an enlarged fragmentary cross-sectional view of an essential part of the electron gun of FIG. 2.

FIG. 3 is an enlarged fragmentary cross-sectional view of an essential part of the electron gun of FIG. 2. The cathode structure 20 houses a heater 31 which is fixed to heater supports 32 at its lower ends. Reference numeral 33 denotes a cathode eyelet, which supports the cathode structure 20 at its lower end and thereby fixes it at a required position in the electron gun via a bead support 34 for supporting the cathode structure 20.

Figure 4:
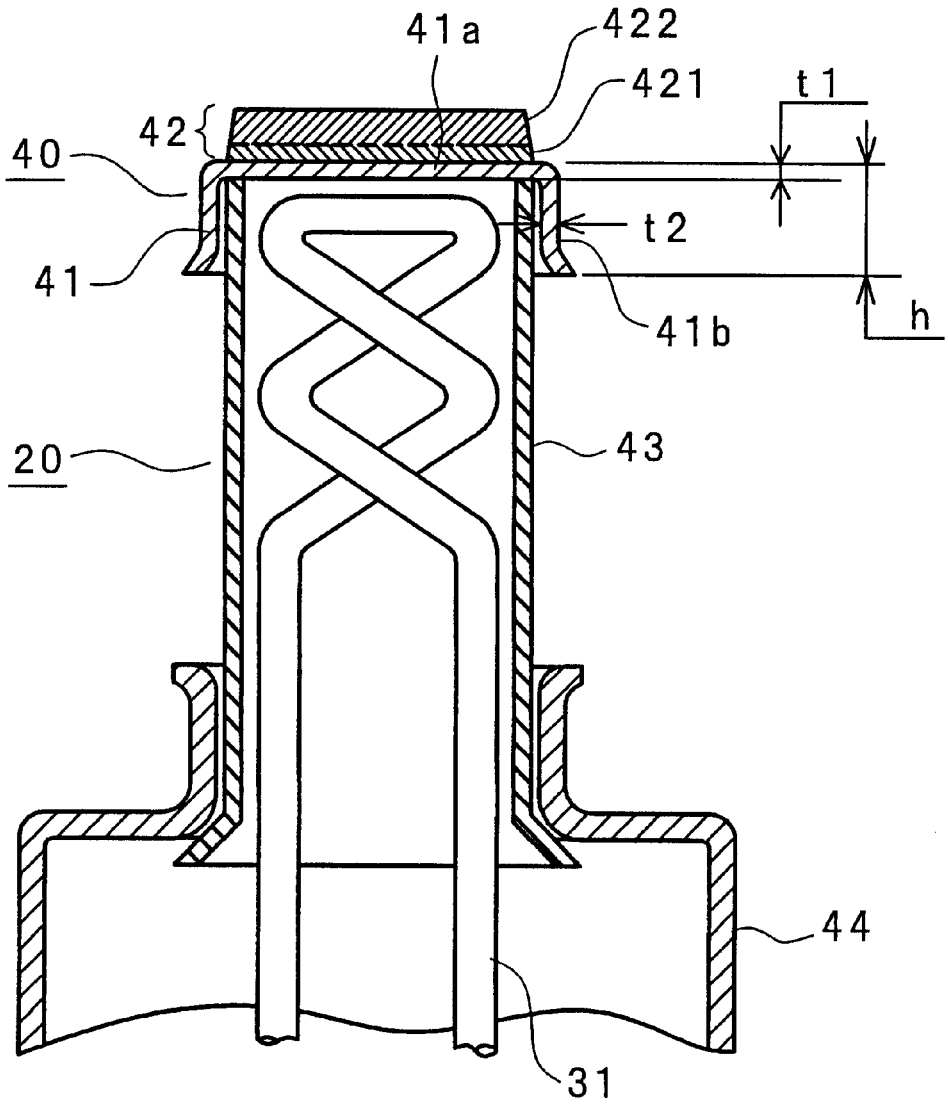
FIG. 4 is an enlarged fragmentary cross-sectional view of an essential part of FIG. 3.

FIG. 4 is an enlarged fragmentary cross-sectional view of an essential part of FIG. 3. Reference numeral 40 denotes a cathode, which comprises a cup-shaped base metal 41 and an electron-emissive material layer 42 formed on a top 41*a* of the base metal 41. Reference numeral 43 denotes a cathode sleeve. One end of the cathode sleeve 43 is fixed to a sidewall 41*b* of the base metal 41 of the cathode 40, and the other end of the cathode sleeve 43 is fixed to a support cylinder 44. The cathode 40, the cathode sleeve 43 and the support cylinder 44 form the cathode structure 20.

The base metal 41 is made of material containing Ni as a main component and incorporated with a low concentration of a reducing metal such as silicon (Si) or magnesium (Mg). The thickness t1 of a portion of the top of the cup-shaped base metal 41 coated with the electron-emissive material layer 42 is 0.14 mm in this embodiment.

The height h and thickness t2 of the sidewall 41*b* of the cup-shaped base metal 41 are 0.5 mm and 0.05 mm, respectively, the specific gravity and specific heat of the base metal 21 are 8.9 and 0.148 cal/° C./g, respectively, and the weight of the cup-shaped base metal 41 is 3.4 mg.

It is preferable that the ratio of t2 to t1 lies in a range of ⅕ to ⅗, and the exhaustion of a reducing agent in the base metal can be delayed by increasing the thickness t1.

The wall thickness of the cathode sleeve 43 is made as thin as 0.018 mm in view of reduction of the image-forming warm-up time, and the diameter of the cathode sleeve 43 is chosen to be 1.57 mm. The base metal 41 and the support cylinder 44 are fixed to the cathode sleeve 43 by using a usual laser weld technique.

The desired amounts of diffusion of a reducing agent and production of barium are secured by using one or both of Si and Mg as a reducing metal.

The electron-emissive material layer 42 is in the form of a two-layer structure comprising a first layer 421 and a second layer 422 formed on the base metal 41 by a usual spray coating technique. The first layer 421 on the base metal side is made of alkaline earth metal oxide, and the second layer 422 comprises alkaline earth metal oxide and about one weight percent of rare earth metal oxide, composite oxide such as $Ba_2Sc_2O_5$, for example, dispersed in the alkaline earth metal oxide.

In the electron-emissive material layer 42 in this embodiment, the first layer 421 is made of an alkaline earth metal oxide converted from triple carbonates containing Ba, Sr and Ca carbonates, ($(Ba,Sr,Ca)CO_3$) or the like, and the second layer 422 is an alkaline earth metal oxide layer in which a rare earth metal oxide is dispersed, obtained by converting triple carbonates containing Ba, Sr and Ca carbonates, ($(Ba,Sr,Ca)\ CO_3$) or the like, mixed with a barium scandate ($Ba_2Sc_2O_5$) or the like.

Figure 5:
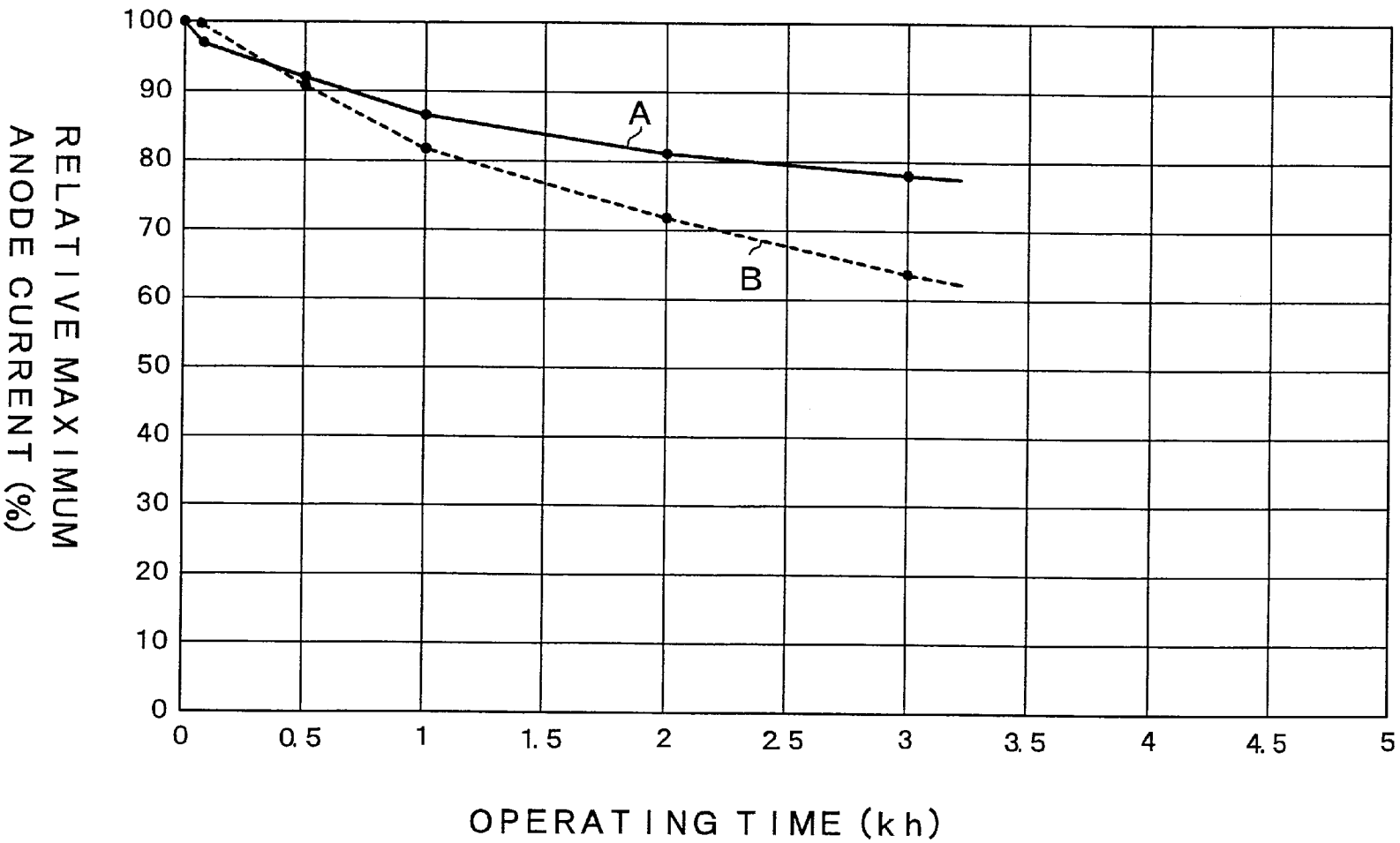
FIG. 5 is a graph showing an operational characteristic of cathode ray tubes with a particle size of a rare earth metal oxide as a parameter.

FIG. 5 is a graph showing a relationship between electron emission life and particle sizes of a rare earth metal oxide, a barium scandate ($Ba_2Sc_2O_5$), for example, dispersed in the second layer 422, based upon an acclerated test with a cathode loading of 6 A/cm$^2$ by using a cathode ray tube incorporating a cathode fabricated according to a specification described subsequently.

In FIG. 5, curve A represents the electron emission life of this embodiment employing the second layer 422 having a particle size distribution of barium scandate in which the number of particles having the maximum diameter over 5 μm is one or none, the number of particles having the maximum diameter in a range of from 1 μm to 5 μm is in a range of from 2 to 30, as measured in an area of 45 μm×45 μm at a center of a top surface of the second layer 422 , and curve B represents the electron emission life of a conventional cathode employing the second layer having a particle size distribution of barium scandate in which the number of particles having the maximum diameter over 5 μm is at least 3, the number of particles having the maximum diameter in a range of from 1 μm to 5 μm is at least 10, as measured in an area of 45 μm×45 μm at a center of a top surface of the second layer.

Next, a method of measuring the maximum diameter of the rare earth metal oxide particles will be explained.

Figures 7, 8:
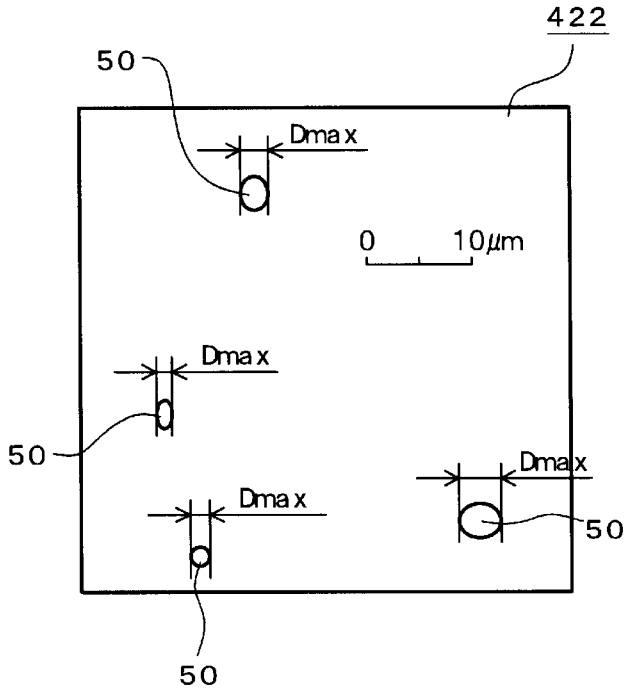
FIG. 7 is a sketch of an electron microphotograph of an area 45 $\mu$m×45 $\mu$m at the center of the top surface of an example of a second layer in the present invention and for defining the maximum diameter Dmax.
FIG. 8 is a table specifying a particle size distribution in the area of 45 $\mu$m×45 $\mu$m at the center of the top surface of the second layer in the present invention in comparison with a prior art cathode.

An image of the rare earth metal oxide particles in an area of 45 μm×45 μm at a center of a top surface of the second layer 422' was obtained by bombarding the area with electrons using a scanning electron microscope type wavelength dispersive x-ray spectrometer, SEM-WD x 65O (a trade name) manufactured by Hitachi, Ltd. The maximum diameters Dmax of the rare earth metal oxide particles were measured on the enlarged images of the particles. FIG. 7 is a sketch of an electron microphotograph of an area 45 μm×45 μm at the center of the top surface of an example of the second layer 422 in the present invention, and the maximum diameter Dmax of each of the rare earth metal oxide particles 50 is defined as the perpendicular projection, onto a horizontal direction, of the tangents to the extremities of the particle profile Feret's diameter, see Perry's Chemical Engineers' Handbook, Sixth Edition, p. 8–6, McGraw-Hill Company, New York) as indicated in FIG. 7. FIG. 8 tabulates the specification of the particle size distribution in the area of 45 μm×45 μm at the center of the top surface of the second layer 422 in the present invention in comparison with the prior art cathode.

As is apparent from FIG. 5, curve B shows that, in the conventional cathode employing the prior art particle size distribution of barium scandate, the rate of decrease of the maximum anode current increases with increasing operating time, thereby its operational characteristics deteriorate rapidly and it is difficult to lengthen the cathode life.

On the other hand, curve A shows that, in this embodiment employing the particle size distribution of barium scandate in accordance with the present invention, its operational characteristics deteriorate less compared with the conventional cathode and consequently, this makes it possible to lengthen the cathode life.

By various experiments including the above-described embodiment, the present inventors have found out that, if the average diameter of the rare earth metal oxide particles dispersed in the second layer exceeds 1.0 μm, its operational characteristics deteriorate rapidly and it is difficult to lengthen the cathode life, and on the other hand, if the average diameter of the rare earth metal oxide particles dispersed in the second layer is smaller than 0.2 μm, there is a tendency for the rare earth metal oxide particles to aggregate because the average diameter of the rare earth metal oxide particles is smaller than that of the alkaline earth metal oxide particles contained as a main component in the second layer, and this aggregation is undesirable for fabrication of the electron-emissive material layer.

FIG. 8 is a table obtained by modifying the results of the above-explained experiments for the purpose of making possible production control by observing the top surface of the second layer of the electron emissive material layer.

The following will explain an example of a method of fabricating the first layer 421 made of the alkaline earth metal oxide and the second layer 422 which is the alkaline earth metal oxide layer in which the rare earth metal oxide is dispersed.

First, a first suspension is prepared for the fabrication of the first layer 421 made of the alkaline earth metal oxide.

Initially, triple carbonates containing Ba, Sr, and Ca carbonates, ($(Ba,Sr,ca)\ CO_3$) are precipitated by adding sodium carbonate ($Na_2CO_3$) to a mixed solution containing a solute composed of 54 weight percent of barium nitrate ($BaNO_3$), 39 weight percent of strontium nitrate ($SrNO_3$) and 7 weight percent of calcium nitrate ($CaNO_3$). The obtained particles of carbonates containing Ba, Sr, and Ca carbonates, ((Ba,Sr,Ca) $CO_3$) are needle crystals of about 15 $\mu$m in average diameter.

Then nitrocellulose lacquer and butyl acetate are added to the above precipitations (powders) and are mixed with them by rolling to obtain the first suspension.

Next, a second suspension is prepared for forming the second layer 422 which is an alkaline earth metal oxide layer in which rare earth metal oxide is dispersed.

Initially, triple carbonates containing Ba, Sr and Ca carbonates, ((Ba,Sr,Ca)$CO_3$), are precipitated by adding sodium carbonate ($Na_2CO_3$) to a mixed solution containing a solute composed of 57 weight percent of barium nitrate ($BaNO_3$), 42 weight percent of strontium nitrate ($SrNO_3$) and 1 weight percent of calcium nitrate ($CaNO_3$).

The obtained particles of carbonates containing Ba, Sr and Ca carbonates, ((Ba,Sr,Ca)$CO_3$), are needle crystals of about 15 $\mu$m in average diameter.

Then, one weight percent of barium scandate ($Ba_2Sc_2O_5$) powders of 0.5 $\mu$m in average diameter as measured using an air permeability method with a Sub-Sieve Sizer (a trade name) manufactured by Fisher Co., for example, are mixed with the above precipitations (powders), and then nitrocellulose lacquer and butyl acetate are added to this mixture and are mixed together by rolling to obtain the second suspension.

Then the first suspension is sprayed on the top 41*a* of the cup-shaped base metal 41 made chiefly of nickel (Ni) to form a first sprayed layer of about 17 $\mu$m in thickness intended for the first layer 421, and then the second suspension is sprayed on the first sprayed layer to form a second sprayed layer of about 60 $\mu$m in thickness intended for the second layer 422.

The barium scandate ($Ba_2Sc_2O_5$) particles are fabricated by coprecipitation and are polyhedral.

Next, during the evacuation step in the fabrication of a cathode ray tube, the first and second sprayed layers are heated by the heater 31 so as to decompose the carbonates containing Ba, Sr and Ca carbonates, ((Ba,Sr,Ca)$CO_3$), in the sprayed layers into oxides of barium, strontium, and calcium, ((Ba,Sr,Ca)O), and form the first layer 421 made of the alkaline earth metal oxide and the second layer 422 which is the alkaline earth metal oxide layer having the rare earth metal oxide dispersed therein.

After that, during the fabrication of the cathode ray tube, the electron-emissive material layer 42 composed of the first and second layers 421, 422 is activated by heating in a range of from 900 to 1100° C. and then is subjected to an aging process step, thereby to form a desired cathode.

With the cathode having the electron-emissive material layer 42 of the above configuration, in the second layer 422 which is the alkaline earth metal oxide layer having dispersed therein a rare earth metal oxide such as barium scandate ($Ba_2Sc_2O_5$), free barium (Ba) is maintained at a high concentration in the electron emissive material layer 42 by the free-barium-confining function of the rare earth metal oxide, and thereby the state of high concentration of donors is prolonged and production of Joule heat is limited to provide a cathode having the electron-emissive material layer 42 exhibiting superior high current density operating characteristics. Further, long emission life is obtained because evaporation of barium is suppressed and thereby high concentration of free barium is maintained.

Especially, this effect is approximately proportional to the total surface area of the rare earth metal oxide particles dispersed in the electron-emissive layer 42, is pronounced when the average diameter of the rare earth metal oxide particles is in a range of 0.2 $\mu$m to 1.0 $\mu$m, and consequently, makes possible the reduction of the thickness of the cathode base metal.

In this embodiment, a composite oxide of barium (Ba) and scandium (Sc), that is, barium scandate ($Ba_2Sc_2O_5$) is used as a rare earth metal oxide to be dispersed in the alkaline earth metal oxide material layer 422 having rare earth metal oxide dispersed therein, but the present invention is not limited thereto and oxides of other rare earth metal can be used for the present invention.

For example, other composite oxides of barium (Ba) and scandium (Sc), $Ba_3Sc_4O_9$, $BaSc_2O_4$, $Ba_6Sc_6O_{15}$; scandium oxide ($Sc_2O_3$); composite oxides of barium (Ba) and yttrium (Y), $Ba_3Y_4O_9$, $BaY_2O_4$; a composite oxide of barium (Ba) and cerium (Ce), $Ba_3Ce_4O_9$; and $Sr_2Sc_4O_8$ and $CaSc_4O_9$ can also be used either alone or in combination with one or more of the others as rare earth metal oxide dispersed in the alkaline earth metal oxide material layer to obtain the same advantages provided by the above-explained composite oxide of barium (Ba) and scandium (Sc).

In the above embodiment, 1 weight percent of a rare earth metal oxide, a composite oxide of barium (Ba) and scandium (Sc), a barium scandate ($Ba_2Sc_2O_5$) for example, is dispersed in the second layer 422 which is an alkaline earth metal oxide layer having a rare earth metal oxide dispersed therein, but the concentration of the rare earth metal oxide to be dispersed can be arbitrarily chosen in a range of 0.1 weight percent to 10 weight percent.

If the concentration of the rare earth metal oxide dispersed in the second layer 422, a barium scandate ($Ba_2Sc_2O_5$) which is a composite oxide of barium and scandium, for example, is smaller than 0.1 weight percent, the improvement sufficient to reduce the thickness of the base metal 41 can not be obtained.

On the other hand, if the concentration of the rare earth metal oxide dispersed in the second layer 422 exceeds 10 weight percent, there is a tendency for the rare earth metal oxide particles to aggregate because the particle size of the rare earth metal oxide is smaller than that of the alkaline earth metal oxide which is a main component of the second layer 422, and this aggregation is undesirable for fabrication of the electron-emissive material layer. It is preferable that the concentration of the rare earth metal oxide dispersed in the second layer 422 is in a range of 0.5 weight percent to 3 weight percent.

Instead of the rare earth metal oxide, oxide of one or both of magnesium and silicon, $MgSiO_3$, for example, can be dispersed in a range of 0.1 weight percent to 10 weight percent in total, in the second layer 422 to obtain the advantages similar to the above-explained advantages.

The present inventors have carried various experiments on the thickness t1 of a portion of the top 41*a* of the base metal 41 of a cathode on which the electron-emissive material layer 42 is coated, the thickness t2 of the sidewall of the cup-shaped base metal 41 and the height h of the cup-shaped base metal 41.

Figure 6:
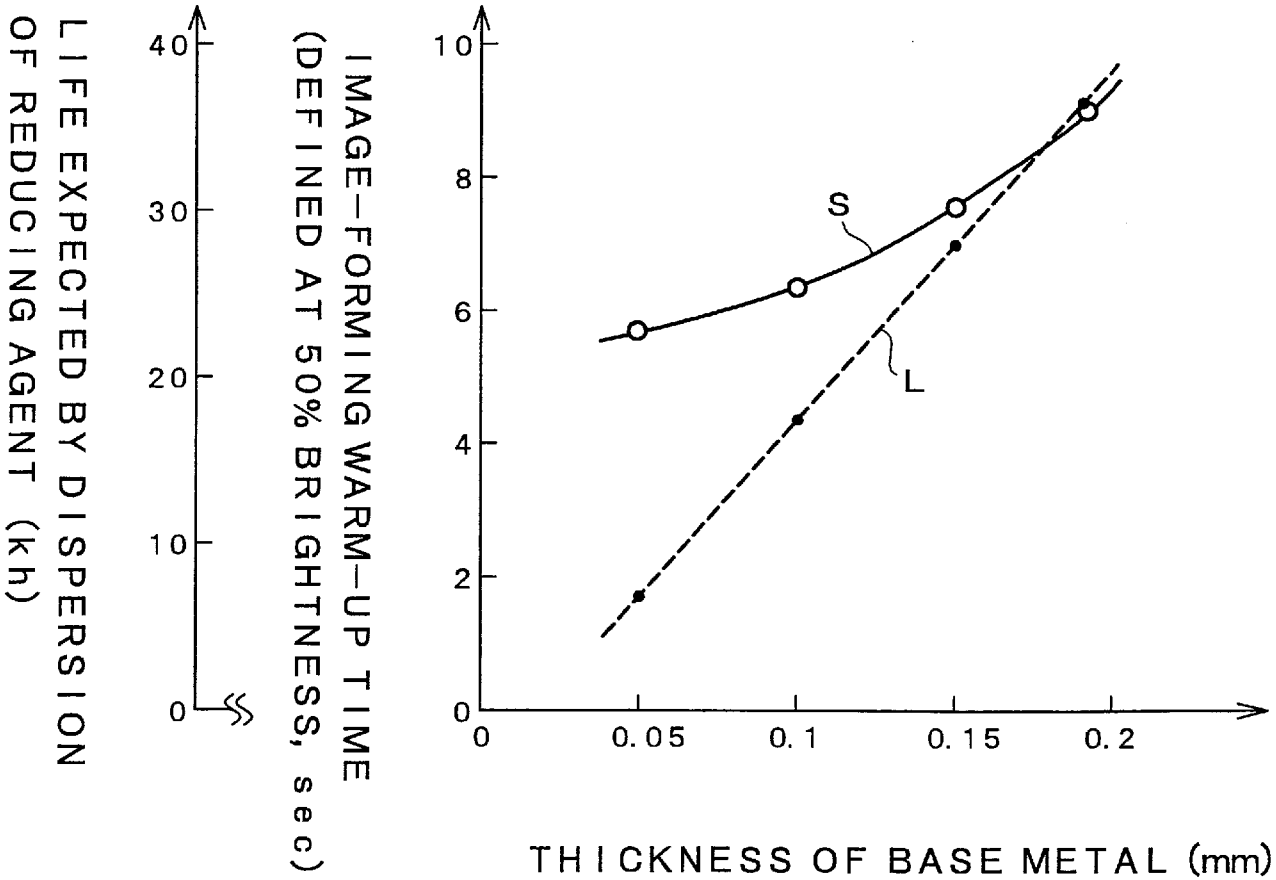
FIG. 6 is a graph showing a relationship between the thickness of a base metal and the life and image-forming warm-up time characteristics.

FIG. 6 is a graph showing relationships between cathode life and the thickness of the cathode base metal and between the image-forming warm-up time and the thickness of the cathode base metal, obtained by calculating the speed of reaction of reduction (the amount of produced free barium) based upon diffusion coefficient in nickel and then applying it for a cathode of a two-layer configuration having a composite oxide of barium (Ba) and scandium (Sc) dispersed therein.

In FIG. 6, curves S and L represent the image-forming warm-up time and the life expectancy, respectively. Usually, life of a cathode ray tube is said to be 18,000 hours or more in general. As is evident from FIG. 6, for securing the life time of 18,000 hours or more, the thickness t1 must be chosen to be 0.1 mm or more, and for limiting the image-forming warm-up time to 8 seconds, the thickness t1 must be limited to 0.16 mm.

If the thickness of the base metal is chosen to be smaller than 0.1 mm, improving the electron-emissive material layer 42 only cannot secure the above-mentioned required emission life. On the other hand, if the thickness of the base metal is chosen to be larger than 0.16 mm, the image-forming warm-up time is increased, and there arises a problem that the image-forming warm-up time expected by a user can hardly be obtained when this cathode is incorporated into a cathode ray tube used in a monitor at a personal computer terminal, for example. Therefore the thickness t1 in a range of 0.12 mm to 0.14 mm provides more beneficial effects.

One embodiment of the present invention has been explained, but the present invention is not limited to the above embodiment, but changes and modifications may be made without departing from the spirit and scope of the invention as defined in the appended claims.

As explained above, the present invention provides a cathode ray tube featuring superior high-current operating characteristics, high brightness and good focus characteristics when it is incorporated in a large-size display monitor, by employing a multilayer configuration for an electron-emissive material layer of a cathode, specifying the average particle diameter and the amount of a rare earth metal oxide such as a barium scandate or other oxides dispersed in the upper layer of the multilayer configuration, and specifying a material of the cathode base metal and thickness of a portion of the base metal in contact with the electron-emissive material layer.

Even if a monitor set is configured such that a power for heaters of a cathode ray tube is automatically turned off for the purpose of power saving when the monitor set is not used, the cathode ray tube according to the present invention can provide the image-forming warm-up time sufficiently short to cause practically no inconvenience after the power for the heaters is turned on again, because of the short time required for the amount of electron emission to reach a desired value after power turn on.

What is claimed is:

1. A cathode ray tube comprising a vacuum envelope including a panel portion, a neck portion and a funnel portion for connecting said panel portion and said neck portion, a phosphor screen formed on an inner surface of said panel portion, and an electron gun housed in said neck portion and including a cathode having an electron-emissive material layer formed on a surface of a cathode base metal, said electron-emissive material layer comprising:

a first layer made of an alkaline earth metal oxide on said surface of said cathode base metal, a second layer being an alkaline earth metal oxide layer containing at least one rare earth metal oxide in a range of 0.1 to 10 weight percent, said at least one rare earth metal oxide having a particle size distribution in which the number of particles having a maximum diameter over 5 $\mu$m is one or none, the number of particles having a maximum diameter in a range of from 1 $\mu$m to 5 $\mu$m is in a range of from 2 to 30, as measured in an area of 45 $\mu$m×45 $\mu$m at a center of a top surface of said second layer, said maximum diameter being defined as a perpendicular projection, onto a horizontal direction, of tangents to extremities of a profile of each of said particles, said second layer being formed on a surface of said first layer;

said cathode base metal being made chiefly of nickel and containing at least one reducing agent, and a thickness of a portion of said cathode base metal in contact with said electron-emissive material layer being in a range of 0.10 to 0.16 mm.

2. A cathode ray tube according to claim 1, wherein said second layer is an alkaline earth metal oxide layer containing at least a scandium oxide ($Sc_2O_3$) and a composite oxide of barium and scandium, in a range of 0.1 to 10 weight percent in total.

3. A cathode ray tube according to claim 1, wherein said at least one rare earth metal oxide is one of $Ba_2Sc_2O_5$, $Ba_3Sc_4O_9$, $BaSc_2O_4$ and $Ba_6Sc_6O_{15}$.

4. A cathode ray tube according to claim 1, wherein said cathode base metal is of a shape of a cup, and a thickness of a sidewall of said cup is in a range of ⅕ to ⅗ of a thickness of a portion of a top of said cathode base metal in contact with said electron-emissive material layer.

5. A cathode ray tube according to claim 1, wherein said at least one reducing agent is one of magnesium and silicon.

* * * * *